US005352001A

United States Patent [19]

Shieh

[11] Patent Number: 5,352,001

[45] Date of Patent: Oct. 4, 1994

[54] DOOR BOLT

[76] Inventor: Jin-Ren Shieh, No. 178, Shih Chia Rd., Taichung, Taiwan

[21] Appl. No.: 136,694

[22] Filed: Oct. 15, 1993

[51] Int. Cl.[5] ..... E05C 5/02

[52] U.S. Cl. ..... 292/57; 292/341.18; 292/DIG. 60

[58] Field of Search ..... 292/DIG. 53, DIG. 60, 292/57, 341.18, 341.19, 337

[56] References Cited

U.S. PATENT DOCUMENTS

| | | | |
|---|---|---|---|
| 629,060 | 7/1899 | Bayles | 292/57 |
| 2,767,007 | 10/1956 | Burke | 292/341.18 X |
| 3,385,624 | 5/1968 | Baclini | 292/341.18 |
| 4,305,611 | 12/1981 | Robins | 292/341.19 X |
| 5,085,019 | 2/1992 | Van Herpen | 292/57 X |

*Primary Examiner*—Rodney M. Lindsey
*Attorney, Agent, or Firm*—Browdy and Neimark

[57] ABSTRACT

An improved door bolt comprises a slide bar seat, a slide bar disposed in an axial hole of the slide bar seat, a bolt button fastened to the slide bar, and an outer seat provided with a recessed portion having two open ends and two opposite side walls. Located symmetrically in the two opposite side walls are a plurality of parallel grooves. The slide bar seat is mounted in the recessed portion such that two wings of the slide bar seat are slidably inserted into two opposite grooves. A slide bar retainer seat is provided with a retaining hole and an inner sleeve mounted in the retaining hole in such a manner that the inner sleeve can be caused to move along the direction of the longitudinal axis of the retaining hole.

6 Claims, 4 Drawing Sheets

DOOR BOLT

FIELD OF THE INVENTION

The present invention relates generally to a door bolt, and more particularly to a door bolt having a slide bar and a retaining hole, which always remain coaxial without regard to external circumstances.

BACKGROUND OF THE INVENTION

As shown in FIG. 1, a prior art door bolt has a slide bar seat 1 fastened to the edge of a door, a slide bar 3 disposed in an axial hole 4 of the slide bar seat it and a slide bar retainer seat 5 fastened to a door jamb 6. The slide bar retainer seat 5 is provided with a retaining hole 7, which must be coaxial with the slide bar 3. However, such coaxial arrangement of the slide bar 3 and the retaining hole 7 can be often changed by the displacement of the slide bar seat 1. As a result, the door bolt is useless. Such a displacement of the slide bar seat 1 takes place when the hinged door, to which the slide bar seat 1 is fastened, is caused to diplace horizontally and vertically after a prolonged use of the hinged door.

SUMMARY OF THE INVENTION

It is therefore the primary objective of the present invention to provide an improved door bolt, which overcomes the defective design of the prior art door bolt described above.

The foregoing objective of the present invention is attained by a door bolt which comprises a slide bar seat, a slide bar, a bolt button, a slide bar retainer seat, and an outer seat which is provided horizontally with an open recessed portion having two side walls. Each of the two side walls is provided with a plurality of parallel and symmetrical grooves. The slide bar seat is disposed in the recessed portion such that two winged sides of the slide bar seat are received in two grooves of the recessed portion. As two winged sides of the slide bar seat are so moved as to engage other grooves of the recessed portion, the position of the slide bar is caused to change accordingly. The slide bar retainer seat is provided in its section with a retaining hole having a longitudinal axis and a short axis. The longitudinal axis of the retaining hole is perpendicular to a planar surface defined by the hole axis and the sectional short axis. An inner sleeve is disposed in the retaining hole such that the inner sleeve can be caused to move along the longitudinal axis of the retaining hole. The door bolt can be set at a locking position by moving the slide bar into the tubular hole of the inner sleeve.

As the door, to which the slide bar seat is fastened, is caused to displace horizontally, the slide bar seat can be so moved as to cause its two winged sides to engage with appropriate grooves of the recessed portion of the outer seat, thereby resulting in a horizontal adjustment of the position of the slide bar. As a result, the axis of the slide bar is coaxial with the axis of the tube hole of the inner sleeve. In case the door is caused to displace vertically, the position of the inner sleeve in the retaining hole is changed so as to cause the axis of the tubular hole of the inner sleeve to be aligned with the axis of the slide bar.

DETAILED DESCRIPTION OF THE INVENTION

Figure 1:
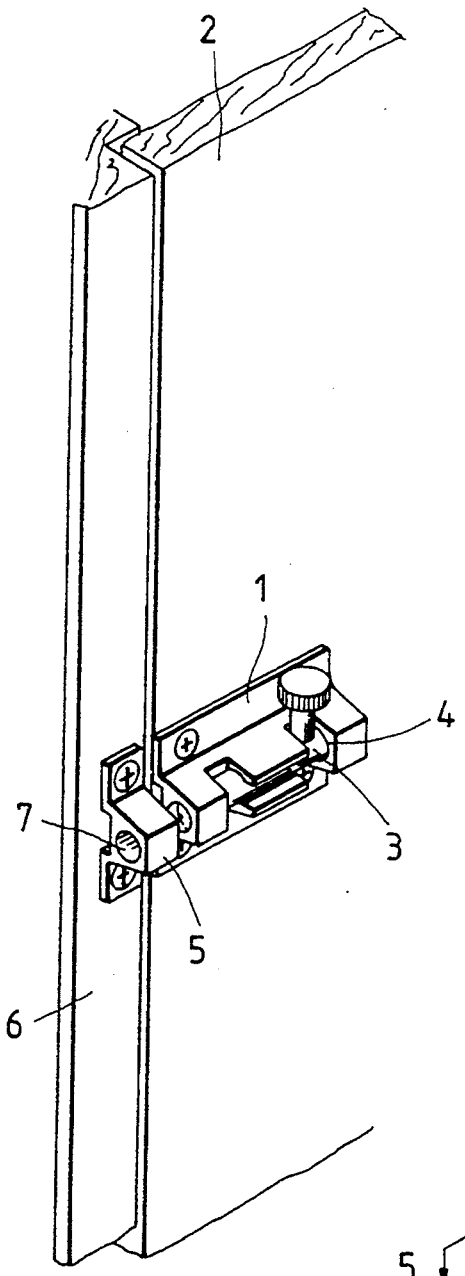
FIG. 1 PRIOR ART
FIG. 1 is a perspective schematic view showing that a prior art door bolt is fastened to a door and a door jamb.
Figure 2:
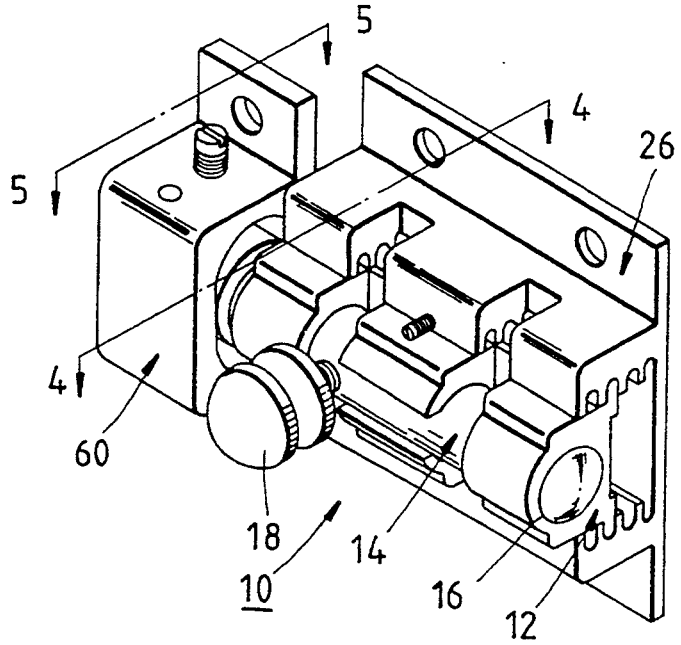
FIG. 2 shows a perspective view of a first preferred embodiment of the present invention.
Figure 3:
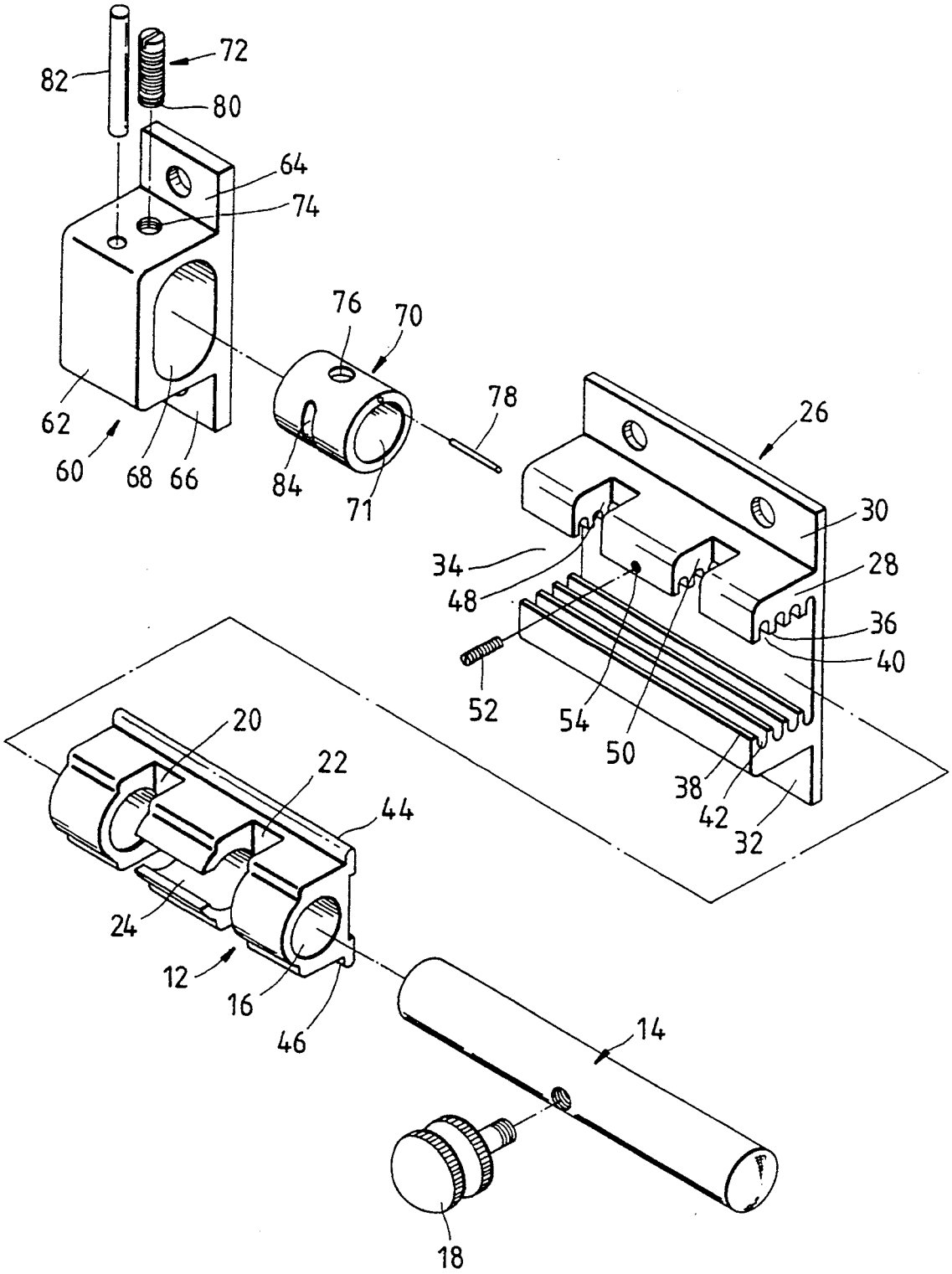
FIG. 3 shows an exploded view of the first preferred embodiment of the present invention.
Figure 4:
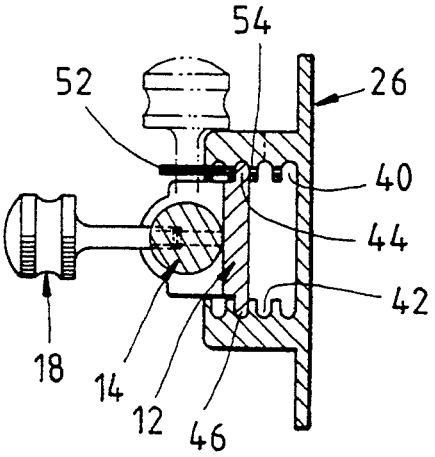
FIG. 4 shows a sectional view of a portion taken along the line 4—4 as shown in FIG. 2.
Figure 5:
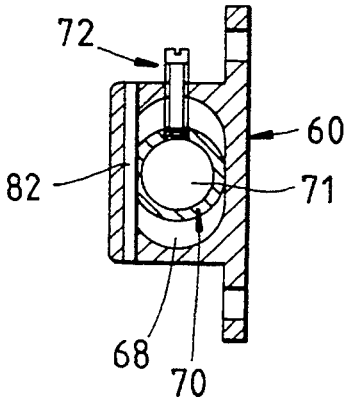
FIG. 5 shows a sectional view of a portion taken along the line 5—5 as shown in FIG. 2.

Referring to FIGS. 2–5, a door bolt 10 of the first preferred embodiment of the present invention is shown to comprise a slide bar seat 12, a slide bar 14 disposed in an axial hole 16 of the slide bar seat 12, a bolt button 18 fastened to the center of the slide bar 14, an outer seat 26, and a slide bar retainer seat 60.

The slide bar seat 12 is provided with two tangent slots 20 and 22, and a passage 24 communicating with the tangent slots 20 and 22 along the axial hole 16. As a result, the slide bar 14 can be caused by the bolt button 18 to slide along the passage 24. In the meantime, the bolt button 18 can be located in both tangent slots 20 and 22.

The outer seat 26 has a rectangular body 28, two wing plates 30 and 32. Located horizontally and along the direction of the longitudinal axis of the rectangular body 28 is a recessed portion 34 with two open ends and two side walls 36 and 38. The two side walls 36 and 38 are provided respectively with four parallel and symmetrical grooves 40 and 42. The slide bar seat 12 is provided horizontally and along both sides of the direction of the longitudinal axis thereof with two wings 44 and 46, which are dimensioned to fit into two grooves 40 and 42 opposite to each other. The position of the slide bar seat 12 can be shifted inwards or outwards by fitting the two wings 44 of the slide bar seat 12 into the opposite grooves 40 and 42 which are located in inner sides and outer sides of the side walls 36 and 38. The "inward shifting" of the slide bar seat 12 refers to the direction toward the bottom of the recessed portion 34 while the "outward shifting" of the slide bar seat 12 refers to the direction toward the open ends of the recessed portion 34. The rectangular body 28 of the outer seat 26 is provided with two tangent slots 48 and 50, which are corresponding in location and dimension to the tangent slots 20 and 22 of the slide bar seat 12. In addition, the slide bar seat 12 can be fastened securely by means of a locating bolt 52 engageable with a threaded hole 54 disposed in the rectangular body 28 such that the threaded hole 54 passes through each of the grooves 40. As the locating bolt 52 is screwed into the threaded hole 54, the tail end of the locating bolt 52 presses securely against the upper wing 44 of the slide bar seat 12. As a result, the slide bar seat 12 is held securely in place.

Figure 6:
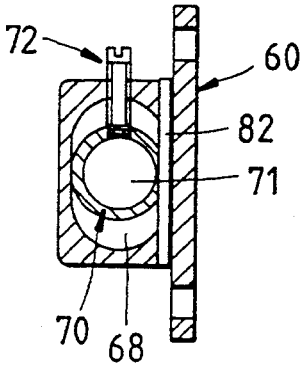
FIG. 6 shows a sectional view of a portion of a second preferred embodiment of the present invention, with the portion being taken along the line similar to the line 5—5 as shown in FIG. 2.

The slide bar retainer seat 60 has a seat body 62 of rectangular construction, and two wing plates 64 and 66 located respectively at both ends of the short axis of the bottom of the seat body 62. In addition, the seat body 62 is provided with a retaining hole 68 which is oval in shape in the cross section of the seat body 62. The retaining hole 68 has in its section a longitudinal axis parallel to the longitudinal axis of the seat body 62. An inner sleeve 70 is disposed in the retaining hole 68 and provided with a tubular hole 71 dimensioned to receive and retain the slide bar 14. The seat body 62 is further provided with a threaded hole 74 having an axis parallel to the longitudinal axis of the retaining hole 68. The threaded hole 74 is engageable with an adjusting bolt 72 having a tail end dimensioned to engage a through hole 76 of the inner sleeve 70. A fastening pin 78 is put through the wall of the inner sleeve 70 to engage an annular groove 80 of the adjusting bolt 72. Therefore, the inner sleeve 70 can be caused to move along the longitudinal axis of the section of the retaining hole 68 by rotating the adjusting bolt 72. The door bolt 10 of the present invention is further provided with a guide rod 82 disposed in the top of the seat body 62 along the longitudinal axis of the slide bar retainer seat 60 for ensuring that the inner sleeve 70 is not caused to move sideways. The guide rod 82 is put through the retaining hole 68 such that the guide rod 82 is capable of engaging a guide slot 84 located in the outer wall surface of the inner sleeve 70. As a result, the movement of the inner sleeve 70 can be securely guided by the guide rod 82 without a risk that the inner sleeve 70 may be caused to move sideways. The guide rod 82 may be disposed securely in the bottom of the seat body 62 of the slide bar retainer seat 60, as shown in FIG. 6.

Figure 7:
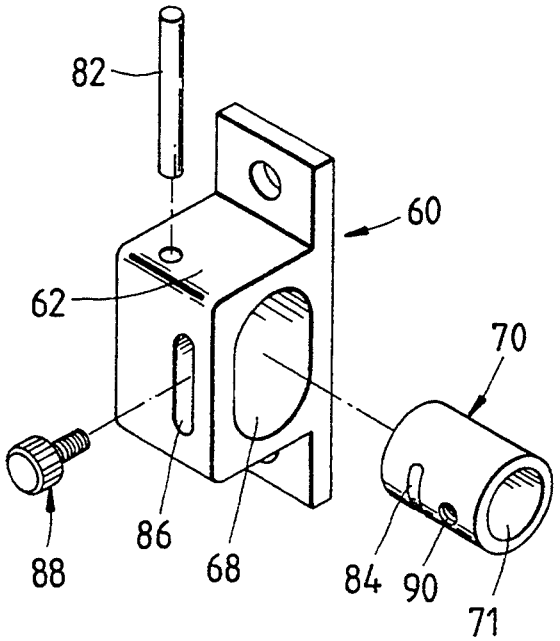
FIG. 7 shows a partial exploded view of the second preferred embodiment of the present invention.

The second preferred embodiment of the present invention is further provided in the top of the seat body 62 of the slide bar retainer seat 60 with a bar hole 86 having a longitudinal axis parallel to the longitudinal axis of the slide bar retainer seat 60, as shown in FIG. 7. An adjustment bolt 88 is put into the retaining hole 68 via the bar hole 86 so as to engage a threaded hole 90 disposed in the outer wall surface of the inner sleeve 70. As the adjustment bolt 88 is loosened, the inner sleeve 70 is caused to move upwards and downwards along the longitudinal axis of the bar hole 86.

Figure 8:
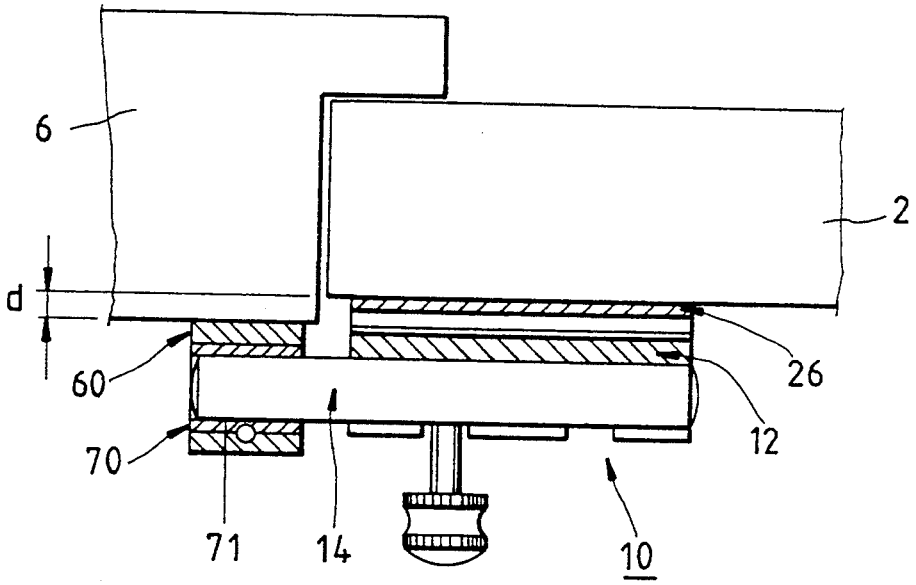
FIG. 8 is a sectional schematic view showing that the door bolt of the present invention is fastened to a door and a door jamb, and that the door is caused to displace horizontally.
Figure 9:
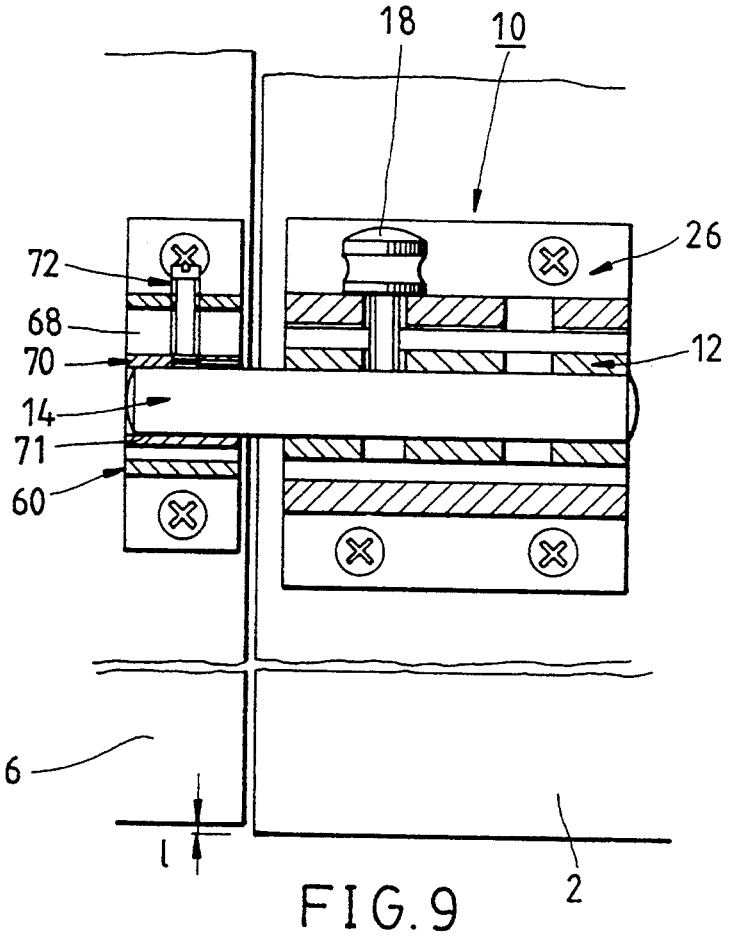
FIG. 9 is a sectional schematic view showing that the door bolt of the present invention is fastened to a door and a door post, and that the door is caused to displace vertically.

The installation of the door bolt 10 of the present invention is illustrated in FIGS. 8 and 9. The outer seat 26 is fastened to the inner side of a door 2 while the slide bar retainer seat 60 is fastened to a door post 6 such that the slide bar retainer seat 60 is corresponding in location to the outer seat 26. Upon the completion of installing the door bolt 10, a distance discrepancy d in the horizontal direction is found between the door 2 and the door post 6. Such distance discrepancy can be compensated by causing the two wings 44 and 46 of the slide bar seat 12 to move into the second pair of grooves 40 and 42 in accordance with the illustration of FIG. 3. As a result, the axis of the slide bar 14 is coaxial with the axis of the tubular hole 71 of the inner sleeve 70.

If the distance discrepancy d described above is found in the vertical direction between the door 2 and the door post 6, a remedial measure can be taken by rotating the adjusting bolt 72 to cause the inner sleeve 70 to move down vertically a distance equal to the distance discrepancy d. As a result, the axis of the slide bar 14 remains coaxial with the axis of the tubular hole 71 of the inner sleeve 70.

What is claimed is:

1. A door bolt for a door comprising:

a slide bar seat 12 provided with an axial hole 16 along a longitudinal axis of said slide bar seat;

a slide bar slidably disposed in said axial hole;

a bolt button fastened to said slide bar;

said slide bar seat being engaged in an outer seat;

a slide bar retainer seat horizontally with] spaced from an end of said outer seat and having a retaining hole to receive said slide bar;

wherein said outer seat is provided along a longitudinal axis thereof with a recessed portion having two open ends and two side walls opposite to each other and defining said recessed portion, said two side walls being provided respectively and symmetrically with a plurality of grooves parallel to the longitudinal axis of said recessed portion; and wherein said slide bar seat is provided with two wings disposed along said longitudinal axis thereof on a side surface thereof such that said two wings extend respectively, outwardly from two edges of said side surface, said two wings being slidably insertable into any two opposite grooves of said plurality of grooves of said outer seat.

2. The door bolt of claim 1 wherein said retaining hole has a longitudinal axis and a short axis, said longitudinal axis being perpendicular to a planar surface including said short axis; an inner sleeve movably engaged in said retaining hole; and adjustment means engaged to said inner sleeve and said retainer seat for moving and locating said inner sleeve along the direction of said longitudinal axis of said retaining hole.

3. The door bolt of claim 1 further comprising a locating bolt engageable with a threaded hole disposed in one of said two side walls of said recessed portion such that said threaded hole passes through each of said grooves located in said one of said two side walls and that said threaded hole is normal to each of said grooves located in said one of said two side walls; wherein a tail end of said locating bolt urges one of said two wings of said slide bar seat at the time when said slide bar seat is mounted in said recessed portion.

4. The door bolt of claim 2 wherein said adjustment means comprises an adjusting bolt engageable with a threaded hole having an axis parallel to said longitudinal axis of said retaining hole, said adjusting bolt having a tail end engaged to said inner sleeve to permit said inner sleeve to be moved along the direction of said longitudinal axis of said retaining hole by rotating said adjusting bolt.

5. The door bolt of claim 2 wherein said adjustment means comprises a bar hole in said slide bar retaining seat, said bar hole having a longitudinal axis parallel to said longitudinal axis of said retaining hole, said bar hole being in communication with said retaining hole and dimensioned to permit an adjustment bolt to pass therethrough to enter said retaining hole in which a tail end of said adjustment bolt engages a threaded hole of said inner sleeve, said adjustment bolt having a head greater in dimension than a width of said bar hole.

6. The door bolt of claim 5 further comprising a guide rod fastened to said slide bar retainer seat such that an axis of said guide rod is parallel to said longitudinal axis of said retaining hole, and that a portion of said guide rod is situated on one side of said short axis of said retaining hole, and further that a tail end of said guide rod engages a guide slot of said inner sleeve which can be therefore caused to move along the direction of said axis of said guide rod.

* * * * *